US005580321A

United States Patent [19]

Rennhack

[11] Patent Number: 5,580,321

[45] Date of Patent: Dec. 3, 1996

[54] GOLF SWING TRAINING DEVICE

[75] Inventor: David B. Rennhack, Coppell, Tex.

[73] Assignee: Swing Wave Golf Corporation, Dallas, Tex.

[21] Appl. No.: 399,881

[22] Filed: Mar. 7, 1995

Related U.S. Application Data

[63] Continuation-in-part of Ser. No. 275,678, Jul. 15, 1994, abandoned.

[51] Int. Cl.[6] ..... A63B 69/36

[52] U.S. Cl. ..... 473/234; 473/256; 482/109

[58] Field of Search ..... 273/194 R, 193 A, 273/186.1, 193 R, 170, 80.7; 473/234, 256, 233; 482/109

[56] References Cited

U.S. PATENT DOCUMENTS

| | | | |
|---|---|---|---|
| 1,020,018 | 3/1912 | Bonin | 273/80.7 |
| 2,464,850 | 3/1949 | Crawshaw | 273/80.7 X |
| 2,747,878 | 5/1956 | Paton | 273/194 R X |
| 3,037,777 | 6/1962 | Chedister et al. | 273/194 R X |
| 4,378,113 | 3/1983 | Piccini | 482/109 |
| 5,026,063 | 6/1991 | Rhodes | 273/193 A X |
| 5,316,300 | 5/1994 | Simmons | 273/170 X |
| 5,452,889 | 9/1995 | Lewinski et al. | 273/170 X |

*Primary Examiner*—George J. Marlo
*Attorney, Agent, or Firm*—Harrison & Egbert

[57] ABSTRACT

A golf swing training device including a chamber having a liquid-receiving interior and a shaft connected to an end of the chamber. The shaft includes a gripping area opposite the chamber. A liquid partially fills an interior of the chamber. The chamber includes a tubular body, a first cap affixed in liquid-tight relationship to one end of the tubular body, and a second cap affixed in liquid-tight relationship to an opposite end of the tubular body. The shaft has the shape of a conventional golf club shaft. The movement of liquid within the chamber provides the golfer with immediate feedback as to the correctness of the swing.

13 Claims, 1 Drawing Sheet

GOLF SWING TRAINING DEVICE

RELATED APPLICATIONS

The present application is a continuation-in-part of U.S. patent application Ser. No. 08/275,678, filed on Jan. 15, 1994, and entitled "GOLF SWING TRAINING DEVICE", now abandoned.

TECHNICAL FIELD

The present invention relates to devices for training the swing of a golfer. More particularly, the present invention relates to golf swing training devices that utilize fluidic action so as to improve the wrist action and swing motion of the golfer.

BACKGROUND ART

The game of golf is rapidly growing in popularity, both in the United States and elsewhere around the world. As a result of the rapid growth and the number of individuals playing the game of golf, there is a corresponding increase in the number of relatively inexperienced players. These players are constantly struggling with their games. Indeed, beginners may find that the game is frustrating and not enjoyable.

At the same time, more experienced players are becoming more and more interested in improving their games. Often, very experienced players can find themselves adopting very bad habits with their swings. Whenever these bad habits develop, then the consistency and accuracy of the swing is diminished. Many good players find it virtually impossible to correct these bad habits in their swings. Many techniques have been employed in the past so as to facilitate the correction of such bad habits. However, heretofore, these techniques have been largely unsuccessful in permanently correcting the bad swing habits of the golfer.

In any good golf swing, it is important that the wrist of the golfer be properly cocked with the back swing of the golfer. If the wrists are not properly cocked, then the alignment and accuracy of the swing becomes diminished. It is important that the golfer consistently "cock" their wrists in the proper position prior to the down swing.

In golf, the follow-through of the swing is also an important consideration. If the follow through in the swing is not proper, then the consistency of the swing becomes diminished. It is important that the follow through be very smooth and consistent with the line of the swing. If the follow-through is out-of-line, then it is very likely that the back swing is out of line also.

It is an object of the present invention to provide a golf swing training device that serves to improve the swing of the golfer.

It is another object of the present invention to provide a golf swing training device that teaches the effective cocking of the wrist prior to the shot.

It is another object of the present invention to provide a golf swing training device that teaches a consistent transition from the back swing to the down swing.

It is another object of the present invention to provide a golf swing training device that helps the golfer to develop a proper and consistent swing.

It is still object of the present invention to provide a golf swing training device that is easy to use, relatively inexpensive, and easy to manufacture.

These and other objects and advantages of the present invention will become apparent from a reading of the attached specification and appended claims.

SUMMARY OF THE INVENTION

The present invention is a golf swing training device that comprises a chamber having a liquid-receiving chamber and having a headless end, and a shaft connected to an end of the chamber opposite the headless end and having a gripping area opposite the chamber.

A liquid partially fills the interior of the chamber. The chamber has a threaded opening opposite the headless end. This opening threadedly receives an end of the shaft therein.

The chamber is made up of a tubular body, a first cap affixed in liquid-tight relationship to one end of the tubular body, and a second cap affixed in liquid-tight relationship to an opposite end of the tubular body. The tubular body has a liquid contained therein between the first and second caps. This liquid fills less than three-quarters of the tubular body. The second cap is provided with a threaded opening therein. This threaded opening serves to receive an end of the shaft. The tubular body is of a clear material.

The shaft has a shape of a golf club shaft. This shaft terminates at the chamber. In one embodiment of the present invention, this chamber has a length of less than one and a half feet and an inner diameter of no more than two inches. This chamber can be made of an acrylic material. The shaft is of a solid aluminum material.

DETAILED DESCRIPTION OF THE INVENTION

Figure 1:
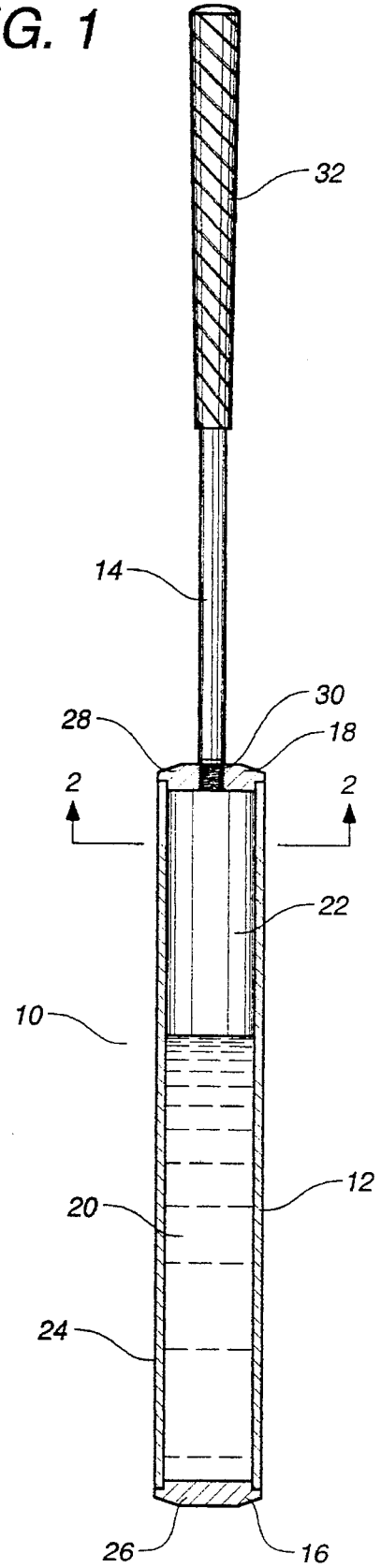
FIG. 1 is a side elevational view of the golf swing training device in accordance with the preferred embodiment of the present invention.

Referring to FIG. 1, there is shown at 10 the golf swing training device in accordance with an embodiment of the present invention. The golf swing training device 10 includes a chamber 12 and a shaft 14. The chamber 12 has one headless end 16 and an opposite end 18 which is connected to the shaft 14. A liquid, such as water, is received within the liquid-receiving interior 22 of the chamber 12.

The chamber 12 includes a tubular body 24, a first cap 26 and a second cap 28. The tubular body 24 is made of a clear material, such as acrylic. The first cap 26 is affixed to one end of the tubular body 24 in liquid-tight relationship therewith. The first cap 26 is sealed to the end of the tubular body 24. The second cap 28 is also sealed to an end of the tubular body 24 opposite the first cap 26. The second cap 28 includes a threaded opening 30 therein. The second cap 28 is secured, in liquid-tight relationship, to the tubular body 24.

It can be seen that the shaft 14 has one end that is threadedly received within the threaded opening 30 of the second cap 28. The end of the shaft 14 will have external threads that are received by the internal threads formed in the opening 30 of the second cap 28. When the shaft 14 is threadedly received within the threaded opening 30 of the second cap 28, the interior 22 of the chamber 12 will be sealed from water leakage. The shaft 14 includes a gripping area 32 at an end opposite the chamber 12. The shaft 14 has a configuration similar to that of a normal golf club. The lower end of a normal golf club is replaced by the chamber 12, which is headless. As a result, the device 10 cannot be actually used for striking a golf ball.

The liquid 20 is received within the interior 22 of the chamber 12. In an embodiment of the present invention, the liquid 20 should fill no more than three-quarters of the interior volume 22. The liquid 20 can be introduced into the interior volume 22 by passing water through the threaded opening 30, prior to the installation of the shaft 14. The liquid-tight nature of the end caps 26 and 28 will prevent the liquid 20 from spilling therefrom. In an embodiment of the present invention, the chamber 12 has a length of less than one and a half feet and a interior diameter of no more than two inches. However, within the scope of the present invention, it is possible to expand the size of the chamber 20 in accordance with the needs of the particular golfer.

The shaft 14 is made of a solid aluminum material. Since the shaft 14 is solid, there is no liquid flow between the chamber 12 and the interior of the shaft 14. The shaft 14 is affixed to the chamber 12 so as to seal an end of the chamber opposite the headless end 16. The grip 32 is a conventional golf club webbing grip. The length of the shaft 14 can vary in accordance with the needs of the user. For example, if the user is rather tall, then the shaft 14 can be relatively long. Alternatively, if the device 10 is to be used by children, then the shaft 14 can be relatively short. The volume of water can be varied to fit the individual's needs and strengths.

Figure 2:
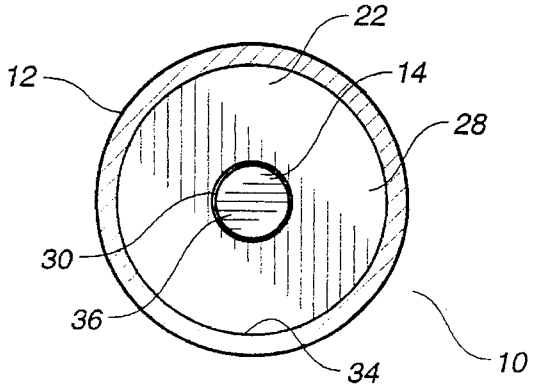
FIG. 2 is a cross-sectional view of the golf swing training device across lines 2—2 in FIG. 1.

FIG. 2 is a cross-sectional view of the chamber 12 of the device 10. It can be seen that the chamber 12 has a circular cross-sectional area. The interior volume 22 is found within the inner diameter 34 of the chamber 12. The end 36 of the shaft 14 is received within the threaded opening 30 in the end cap 28 of the device 10.

Figure 3:
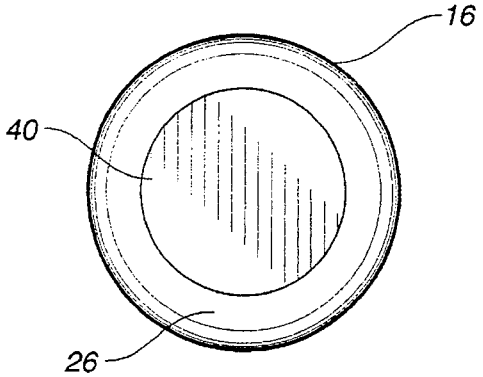
FIG. 3 is an end view of the golf swing training device of the present invention.

FIG. 3 shows an end view of the headless end 16. Specifically, the headless end 16 has a circular configuration. The headless end 16 does not include a golf club head. The headless end 16 is shown as including the first end cap 26. The first end cap 26 will slightly taper toward the bottom 40.

In normal use, the golfer will grip the gripping web 32 of the shaft 14 of the golf swing training device 10 of the present invention. In its downward position, all of the liquid 20 will reside within the liquid-containing chamber 12. So as to properly simulate the golfing swing, the golfer can slowly rotate his or her shoulders so as to rotate the liquid-containing chamber 12 upwardly. If the swing is correct, then water will flow from end cap 26 to the end cap 28 in one manner. Because of the special configuration of the present invention, the golfer is able to "feel" the flow of the water within the chamber 12. The golfer is able to train the swing by the "feel" of the flow of the water within the chamber 12 and also by the sound that is created by such water flow. Generally, if the swing is smooth, then a "sloshing" effect will not occur. There will be a generally smooth flow of water from one end cap to the other end cap. The sound and feel of the device 10 will facilitate the creation of muscle memory relative to the swing of the golfer. Additionally, the heavier weight of the device 10 will help to build muscles and to strengthen the golfer's swing. Since the chamber 12 is of a clear material, observers, along with the golfer, can easily view the movement of the water. As a result, golf swing instruction is improved. Since the device 10 does not include a club head, it is unlikely that the golfer will adopt bad habits in his or her swing by trying to strike a golf ball with the device. The headless nature of the device 10 makes it clear to the user that the device 10 is simply for improving one's swing pattern.

Experiments have shown that the golfer's swing of a golf club dramatically improves following use of the golf swing training device of the present invention.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A golf swing training device comprising:

a chamber having a liquid-receiving interior, said chamber having a lower end without a golf club head connected thereto;

a liquid partially filling said interior of said chamber; and a shaft connected to an end of said chamber opposite said lower end, said shaft having a gripping area opposite said chamber, said shaft having a longitudinal axis aligned with a longitudinal axis of said chamber.

2. The device of claim 1, said chamber having a threaded opening opposite said lower end, said opening threadedly receiving an end of said shaft therein.

3. The device of claim 1, said chamber comprising:

a tubular body;

a first cap affixed in liquid-tight relationship to one end of said tubular body; and a second cap affixed in liquid-tight relationship to an opposite end of said tubular body.

4. The device of claim 3, said tubular body having said liquid contained therein between said first and second caps.

5. The device of claim 4, said liquid filling less than three-quarters of said tubular body.

6. The device of claim 3, said second cap having a threaded opening therein, said threaded opening for receiving an end of said shaft.

7. The device of claim 1, said shaft having a shape of a golf club shaft, said shaft terminating at said chamber.

8. The device of claim 1, said shaft being solid aluminum shaft, said shaft affixed to said chamber so as to seal said end of said chamber opposite said lower end.

9. A golf swing training device comprising:

a single chamber partially filled with a liquid, said liquid being freely flowable between ends of said chamber; and a shaft connected to one end of said chamber so as to completely seal an interior of said chamber, said shaft having a configuration of a conventional golf club shaft, said shaft having a longitudinal axis aligned with a longitudinal axis of said chamber.

10. The device of claim 9, said chamber having a lower end opposite said end connected to said shaft, said lower end being without a golf club head attached thereto.

11. The device of claim 10, said chamber having a threaded opening opposite said lower end, said opening threadedly receiving an end of said shaft therein.

12. The device of claim 9, said chamber comprising:

a tubular body;

a first cap affixed in liquid-tight relationship to one end of said tubular body; and a second cap affixed in liquid-tight relationship to an opposite end of said tubular body.

13. The device of claim 12, said tubular body having said liquid contained therein between said first and second caps, said liquid filling less than three-quarters of said tubular body.

* * * * *